United States Patent [19]

Kochendörfer et al.

[11] Patent Number: 4,542,678

[45] Date of Patent: Sep. 24, 1985

[54] CONTROL ARRANGEMENT FOR HYDRAULIC MOTOR

[75] Inventors: Heinrich Kochendörfer, Kernen; Heinrich Lödige, Vaihingen; Hubert Mohaupt, Bietigheim; Roland Schempp, Vaihingen; Werner Schumacher, Asperg; Raimund Skambraks, Schwieberdingen, all of Fed. Rep. of Germany

[73] Assignee: Robert Bosch GmbH, Stuttgart, Fed. Rep. of Germany

[21] Appl. No.: 424,984

[22] Filed: Sep. 27, 1982

[30] Foreign Application Priority Data

Feb. 26, 1982 [DE] Fed. Rep. of Germany ..... 3206842

[51] Int. Cl.[4] ..... F15B 11/08; F15B 13/044

[52] U.S. Cl. ..... 91/6; 91/31; 91/445; 91/447; 91/450; 91/459; 137/596.13

[58] Field of Search ..... 91/6, 31, 445, 447, 91/448, 450, 451, 459; 137/596.13

[56] References Cited

U.S. PATENT DOCUMENTS 3,053,234 9/1962 Chevreux ..... 91/31
3,088,283 5/1963 Furia et al. ..... 91/451 X
3,209,783 10/1965 Pusch et al. ..... 137/596.13 X
4,066,006 1/1978 Heiser ..... 91/447 X
4,176,685 12/1979 Hoefer et al. ..... 137/596.13

FOREIGN PATENT DOCUMENTS 1928896 11/1970 Fed. Rep. of Germany .

*Primary Examiner*—Irwin C. Cohen
*Attorney, Agent, or Firm*—Michael J. Striker

[57] ABSTRACT

A control arrangement for a hydraulic motor has an adjustable pressure medium supply device with a container, an unblockable check valve with a control connection, a plurality of chambers including a supply chamber, a motor chamber, first and second return chambers, and a control chamber, a control slider displaceable relative to the chambers, wherein a control conduit extends from the supply device and leads to the control chamber, a first pressure control member is arranged on the control slider so that in a lowered position of the latter the first pressure controlling member is located between the control chamber and the second return chamber and the control slider in its raised position blocks the control chamber, and a second pressure controlling member located between the control chamber and the motor chamber and opening into the latter.

9 Claims, 21 Drawing Figures

CONTROL ARRANGEMENT FOR HYDRAULIC MOTOR

BACKGROUND OF THE INVENTION

The present invention relates to a control arrangement for a hydraulic drive or servomotor. More particularly, it relates to an arrangement for a hydraulic drive or servomotor with a control slider which during its raising controls a pressure medium from an adjustable pressure medium supply device via an unblockable check valve to the motor, and during lowering releases the same to a container.

Control arrangements of the above-mentioned general type are known in the art. One such control arrangement is disclosed, for example, in the German Auslegeschrift No. 1,938,896. It serves for controlling a lifting mechanism of a tractor, wherein the control slider is constantly adjustable via a mechanical adjusting linkage. For raising the motor of the lifting mechanism load-independently and in a proportional manner, the control slider cooperates with a reverse valve formed as a three-way flow regulating valve, whereby also in a neutral position of the control slider the neutral reverse pressure can be maintained relatively low. During lowering of the lifting mechanism the control slider must control an unblockable return valve which protects the motor. The disadvantage of this arrangement is that it is relatively expensive inasmuch as for controlling of the simply operating motor two motor chambers are required from which the respective conduits lead to the unblockable check valve. Moreover, there is the disadvantage that the reverse pressure in the neutral position of the control slider must be selected so high that in the lowered position the check valve can unblock. In addition, for a reliable functioning of the mechanically controlled proportionally operating control arrangement, an additional auxiliary slider is required in the main control slider with which a process identified as a fixed throttling is eliminated. This auxiliary slider results, however, in an expensive construction.

SUMMARY OF THE INVENTION

Accordingly, it is an object of the present invention to provide a control arrangement for a hydraulic motor, which avoids the disadvantages of the prior art.

More particularly, it is an object of the present invention to provide a control arrangement for a hydraulic motor which performs conventional functions with smaller costs.

In keeping with these objects and with others which will become apparent hereinafter, one feature of the present invention resides, briefly stated, in a hydraulic arrangement for a hydraulic motor in which a control conduit from a pressure medium supply device leads to a control chamber, a control slider has a pressure controlling member which in a lowered position of the control slider is located between the control chamber and a second return chamber, the control slider blocks the control chamber in its raised position, and a second pressure controlling member is located between the control chamber and a motor chamber and opens into the latter.

When the control arrangement is designed in accordance with the present invention, it eliminates the disadvantages of conventional arrangements and provides for the above-mentioned objects. The control arrangement is space-economical and inexpensive. In addition, the reverse pressure in the neutral position of the control slider is independent of the control pressure for unblocking the check valve, whereby it can lower further.

In accordance with another special advantageous feature of the present invention, the control slider is activated by a proportional magnet against a force of a spring and lies in an electrical position-regulating circuit. When the control arrangement is designed in accordance with these features, the additional auxiliary slider for eliminating the fixed throttling can be dispensed with.

Yet another feature of the present invention is that the proportional magnet is formed as a single-stroke magnet, and the control slider has in addition to its lowered and raised positions, an intermediate position between the lowered and raised positions, and a further position in which the control chamber is released to the second return chamber.

Still another feature of the present invention is that the pressure medium flows back from the motor to the container through the first return chamber, whereas the second return chamber is associated only with a control flow of the check valve and the supply means.

A further feature of the present invention is that the adjustable pressure supply means may include a constant pump and a reverse valve parallel to the supply chamber, or it may include an adjustable pump, wherein the control conduit extends either from the reverse valve or from the adjustable pump.

Still a further feature of the present invention is that the control slider has an additional neutral position which can be located either outside of the lowered and raised positions of the control slider, or between these positions.

An additional feature of the present invention is that the control slider can be provided with at least two control faces which are offset from one another axially and radially and influence the communication from the control chamber to the second return chamber.

The control slider can be centered in its neutral position by a spring and selectively displaceable to its lowered and raised positions by a double acting proportional magnet drive.

The pressure controlling members can be formed as pressure valves or throttles.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
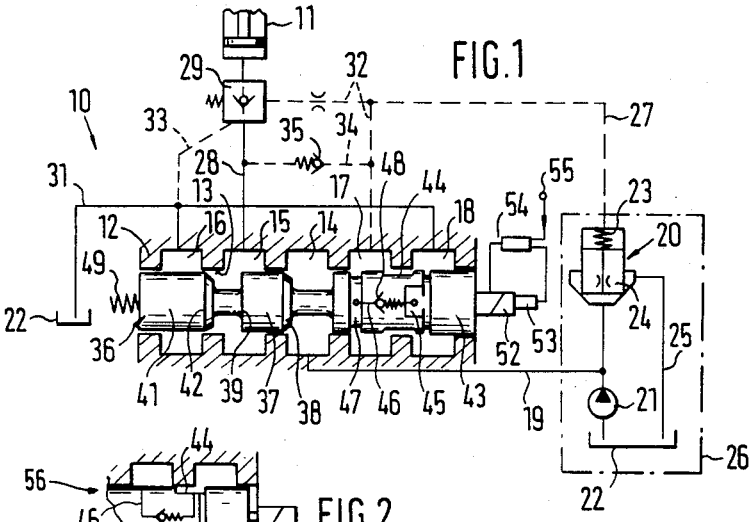
FIG. 1 is a view showing a control arrangement for a hydraulic motor, in accordance with a first embodiment of the invention.

FIG. 1 shows a control arrangement 10 for a hydraulic drive or servomotor 11. The control arrangement 10 has a longitudinal passage 13 provided in a housing 12 and having several ring-shaped extensions which form several chambers. These chambers include a centrally located supply chamber 14, a motor chamber 15 located near the supply chamber 14, a first return chamber 16 located outwardly of the motor chamber 15. At the other side of the supply chamber 14, a control chamber 17 is formed, and a second return chamber 18 is located outwardly of the control chamber 17.

The supply chamber 14 communicates via a supply conduit 19 with an outlet of a pump 21. The pump 21 aspirates the pressure medium from a container 22. A reverse valve 20 is connected in parallel to the supply chamber 14 and has a closing member 24 loaded by a spring 23 and controlling the communication from the pump 21 to a discharge 25. The constant pump 21 forms together with the reverse valve 20 a pressure medium supply device 26. A control conduit 27 extends from the supply device 26. A consumer conduit 28 leads from the motor chamber 15 via an unblockable check valve 29 to a single acting servomotor 11.

Both return chambers 16 and 18 communicate via a branching return passage 31 with the container 22. The first control conduit 27 which comes from the pressure medium supply device 26 leads to the control chamber 17. Simultaneously, a second control conduit 32 extends from this control chamber 17 to a control connection of the unblockable check valve 29. A leakage oil conduit 33 leads from the check valve 29 to the return passage 31. Further, the control chamber 17 communicates via a transverse connection 34 with a pressure valve 35 with the motor chamber 15. The pressure valve 35 opens to the motor chamber 15.

A control slider 36 is sealingly and slidingly guided in the longitudinal passage 13. It has a central piston portion 37 with a control step 38 with which the pressure medium stream flowing to the servomotor 11 can be dosed. A control edge 39 blocks the communication to the first return chamber 16. A left piston portion 41 of the slider has a control step 42 with which the pressure medium stream is controlled during lowering of the servomotor 11. A right piston portion 43 has a first control face 44 and a second control face 45. With the aid of these control faces 44 and 45, the control slider 36 influences the connection between the control chamber 17 and the second return chamber 18. For this purpose, the control faces 44 and 45 are offset relative to one another both in an axial direction and in a circumferential direction.

The right piston portion 43 further has a control passage 46 which extends from an annular groove 47 and opens into the second control face 45 and has connected therein a pressurizing valve 48 which opens to the second control face 45. The control slider 36 is pressed by a spring 49 to its neutral position 51 shown in FIG. 1. The control slider 36 is displaced from this position by a proportional magnet 52. The position of the control slider 36 is determined by an electromechanical displacement pick-up 53 and processed in an electrical position adjusting circuit 54 whose electrical nominal value inlet is identified by reference numeral 55.

Figure 4:
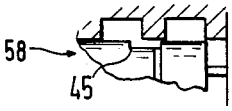
Figure 5:
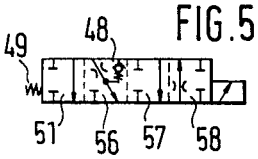
FIG. 5 is a view showing a circuit of the control arrangement of FIG. 1.

The operation of the control arrangement 10 is explained with reference to the drawings including FIGS. 2–4 which show different connections in the control conduit system in different positions of the control slider, whereas FIG. 5 shows the connections for the working pressure medium stream.

In the neutral position of the control slider 36 shown in FIG. 1, the supply chamber 14 is hydraulically blocked. The releasable check valve 29 prevents an unintentional lowering of a load on the servomotor 11. A small control stream flows from the pump 21 via the reverse valve 20, the control conduit 27, the control chamber 17, the first control face 44, the second return chamber 18 and the return passage 31 to the container 22. The pressure drop produced by this control stream lifts the control member 24 against the force of the spring 23 from its seat and releases the pump 21 via the discharge 25 to the container 22. The reverse pressure against which the pump 21 must work can thereby be maintained very low in the neutral position. This neutral position can be utilized both as a working position and as an inoperative position, when the single stroke proportional magnet 52 is not energized.

Figure 2:
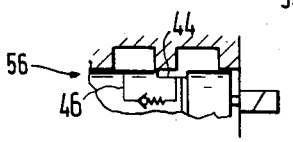
FIGS. 2, 3 and 4 show the control arrangement of FIG. 1 with a control slider in different positions.

As can be seen from FIG. 5, the lower position 56 is connected with the neutral position 51, and the control slider 36 is displaced by the proportional magnet 52 to the position shown in FIG. 2.

In the lowered position, the communication from the control chamber 17 to the second return chamber 18 via the first control face 44 is blocked. The control passage 46 is now connected with the pressurizing valve 48 between both chambers 17 and 18. Thereby the control oil stream is throttled via the control conduit 27 and the pump 21 works against a higher pressure level, so that a sufficiently high control pressure is available for unblocking the check valve 29. The pressure medium can be discharged via the opened check valve 29 from the servomotor 11 via the consumer conduit 28, the motor chamber 15, the control step 42, the first return chamber 16 and the return passage 31 to the container. The control pressure for unblocking the check valve 29 can be adjusted with the aid of the pressurizing valve 48 and thereby lie higher than the neutral reverse pressure, so that a reliable unblocking during lowering can be attained.

Figure 3:
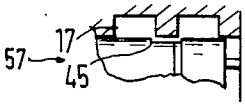

When the control slider 36 is displaced by the proportional magnet 52 stronger against the force of the spring 49, it assumes an intermediate position 57 shown in FIG. 3. In this intermediate position 57, the second control face 45 releases the control chamber 17 to the second return chamber 18. The pump 21 can work against a small neutral reverse pressure as in the neutral position 51. The unblockable check valve 29 secures the servomotor 11.

When the control slider 36 is further displaced over the intermediate position 57 against the force of the spring force 49 it assumes its raised position 58 shown in FIG. 4. The second control face 45 interrupts the release of the control chamber 17, so that no control oil stream can discharge via the reverse valve 20 to the container 22. The pump 21 increases the pressure until it is greater by a predetermined value than the load pressure acting in the servomotor 11. This is provided because the pressure chamber in the reverse valve 20 which receives the spring 23 communicates via the pressure valve 35 with the consumer conduit 28. When the pump pressure is greater by the predetermined value than the load pressure, the pressure medium flows from the pump 21 via the supply chamber 14, the control step 38, the motor chamber 15 and the unblocked check valve 29 to the servomotor 11. The pressure medium stream to the servomotor 11 is controlled independently of the respective load at the servomotor, inasmuch as the control slider 36 and the reverse valve 20 cooperates similarly to a three-way flow regulating valve, and the control steps 38 operate as a measuring orifice with the control member 24 operating as a piston manometer.

With the control arrangement 10, the servomotor 11 can be controlled in a proportional manner, whereas the control slider 36 is directly proportional to the nominal value signal in the inlet 55. The raising process of the servomotor 11 is carried out load-independently. The control slider 36 executes simultaneously the control of the check valve which secures the servomotor 11, and the control of the reverse valve 20. The pressurizing valve 48 makes possible a sufficiently high control pressure for unblocking the check valve 29, independently of the height of the neutral reverse pressure. The energy losses in the neutral position 51 remain low. The control slider 36 is further so designed that it displaces over a relatively great stroke region between the lowered position 56 and the raised position 58, whereas the intermediate position 57 constitutes only a small stroke portion. The associated connections in the control conduit system allows good controlling by the control faces 44 and 45 which are offset relative to one another. By the control of the control slider 36 via the proportional magnet 52 with the associated position-adjusting circuit 54, it is possible to avoid the phenomenon known as fixed throttling, without providing an additional auxiliary slider. By the separate check valve connection for the pressure medium stream flowing back from the servomotor 11 during lowering and for the neutral reverse stream flowing out from the pump via the reverse valve 20, even small loads can be reliably lowered.

Figure 6:
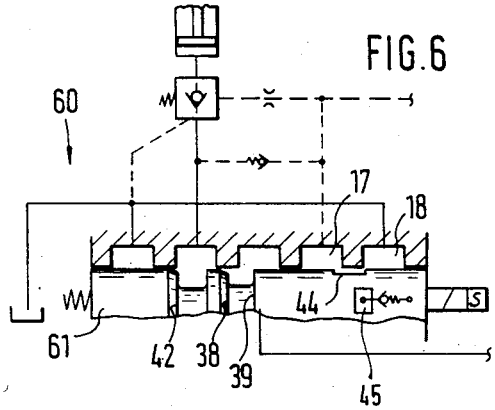
FIGS. 6–10 are views substantially corresponding to the views of FIGS. 1–5, but showing a control arrangement in accordance with a second embodiment of the invention.

FIG. 6 shows a part of a control arrangement 16 according to the second embodiment of the present invention with a control slider 61 which is different from the control slider of FIG. 1 and allows a change of the raised position 58 and the lowered position 56. Other parts shown in FIG. 6 and corresponding to the respective parts of FIG. 1 are identified with the same reference numerals.

Figure 7:
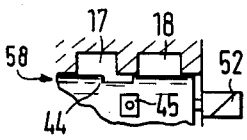
Figure 10:
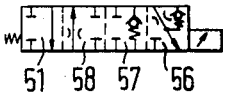

As can be seen from FIG. 6, the control steps 38 and 42 and the control edge 39 are arranged on the control slider 61 so that the raised position 58 shown in FIG. 10 is located between the neutral position 51 and the intermediate position 57, whereas the lowered position 56 is located completely outwardly. In the neutral position 51 of the control slider 61 shown in FIG. 6, the control chamber 16 is released via the first control space 44 to the second return chamber 18. During displacement of the control slider 61 by the proportional magnet 52 against the force of the springs 49, the control slider first assumes the raised position 58 shown in FIG. 7. The connection between both chambers 17 and 18 via the control faces 44 and 45 are blocked.

Figure 8:
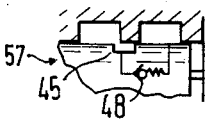
Figure 9:
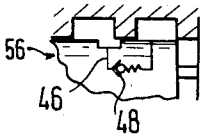

During further displacement of the control slider 31, it assumes its intermediate position 57 shown in FIG. 8. In contrast to the control arrangement 10 of FIG. 1, in the intermediate position of the control slider 61 the control chamber 17 communicates only via the pressurizing valve 48 with the second return chamber 18. The control slider 61 displaced maximum to its lowered position 56 is shown in FIG. 9. In this lowered position the communication via the pressurizing valve 48 between both chambers 17 and 18 is maintained.

Figure 11:
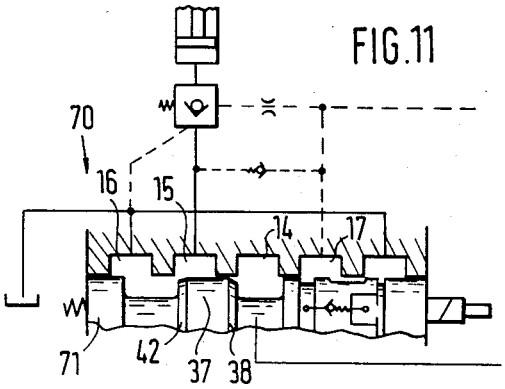
FIGS. 11–15 are views substantially corresponding to the views of FIGS. 1–5, but showing a control arrangement in accordance with a third embodiment of the invention.

FIG. 11 shows a portion of a control arrangement 17 in accordance with a third embodiment of the invention. This control arrangement differs from the control arrangement 10 of FIG. 1 first of all by a different control slider 71, wherein the neutral position 51 is no longer located outwardly, but instead is located in the center of the stroke region of the proportional magnet 52. The other parts of the control arrangement 70 which corresponds to the respective part of the control arrangement 10 are identified with the same reference numerals.

Figure 12:
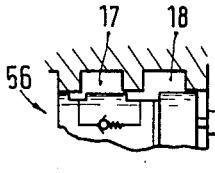
Figure 13:
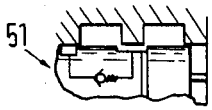
Figure 14:
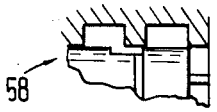
Figure 15:
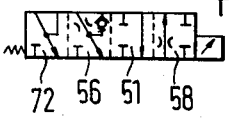

The supply-side control step 38 and the discharge-side control step 42 are arranged in the control slider 71 simultaneously on the central piston portion 37. With the so designed control slider 71, the neutral position 51 in which the motor chamber 15 and the supply chamber 14 are hydraulically blocked and the control chamber 17 is released only to the second return chamber 18, can be obtained in a central stroke region of the proportional magnet 52 as shown in FIG. 13. During maximum displacement of the control slider 71 by the proportional magnet 52 against the force of the spring 49, it assumes its raised position 58 as shown in FIG. 14. By a small displacement of the control slider 71, it assumes its lower position 56 shown in FIG. 12. If the proportional magnet 52 fails, the control slider 71 is pressed by the spring 49 to an inoperative position 72 shown in FIG. 11 in which both the motor chamber 15 and the control chamber 17 are released to the container 22.

The operation of the control arrangement 70 corresponds to the operation of the control arrangement 10, with the consideration that the neutral position for the adjustment is located substantially in the center of the stroke region of the proportional magnet 52. In the event of failure of the proportional magnet 52, the slider 71 throttles by the spring 49 to its inoperative position 72. Thereby it is guaranteed that in the event of the absence of stream no raising or lowering movements can take place.

Figure 16:
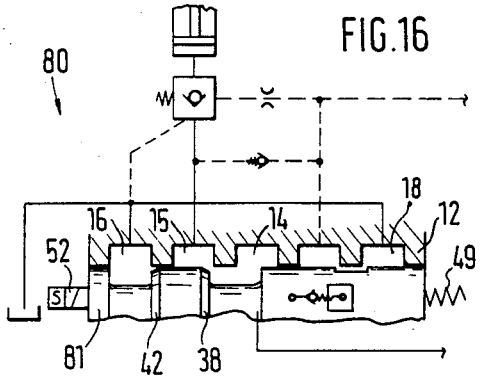
FIGS. 16–20 are views substantially corresponding to the views of FIGS. 1–5, but showing a control arrangement in accordance with a fourth embodiment of the invention.

FIG. 16 shows a part of a control arrangement 18 in accordance with a fourth embodiment of the invention. A control slider 81 of this embodiment differs from the control slider 70 of FIG. 11, and in correspondence with FIG. 6 the raised position 58 and the lower position 56 are exchangeable relative to the neutral position 51 and the inoperative position 72. The proportional magnets 52 and the spring 49 are arranged exchangeable relative to the housing 12. The other parts which are similar to the parts of the previous embodiments are identified with the same reference numerals.

Figure 17:
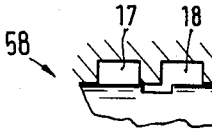
Figure 18:
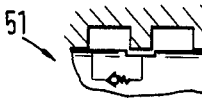
Figure 19:
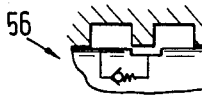
Figure 20:
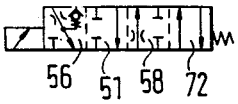

In the beginning of displacement of the control slider 81 from its inoperative position 72 shown in FIG. 16, it first assumes the raised position 58 shown in FIG. 17. In further displacement of the control slider 81, its neutral position 51 shown in FIG. 18 follows. With the maximum displacement of the control slider 81, it attains its lowered position 56 shown in FIG. 19. In contrast to FIG. 11, in the inoperative position 72 of the control slider 81 the chamber 15 communicates with a supply chamber 14 and not with the first return chamber 16 as in FIG. 11. The operation of the control arrangement 80 corresponds to the operation of the control arrangement 70 of the third embodiment, with the difference that starting from the inoperative position 72 first the raised position 58 follows, and during maximum displacement the lowest position 56 is reached.

Figure 21:
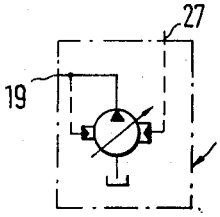
FIG. 21 is a view showing a pressure medium supply device different from that of FIG. 1.

FIG. 21 shows another pressure medium supply device 90 which is formed as an adjustable pump and, instead of the pressure medium supply device 26, is connected with the supply conduit 19 or the first control conduit 27.

It is to be understood that variations of the shown embodiments can also be possible without departing from the invention. First of all, it is possible in the embodiments of FIGS. 11 and 16 to use for actuation of the control sliders 71 and 81 a double stroke proportional magnet, instead of the single stroke proportional magnet 52, and the control slider is centered in its neutral position by springs, so that the inoperative position 72 can be dispensed with without replacement.

If the position adjusting circuits 54 of FIGS. 11 and 16 is not used, the position accuracy decreases. This can be disturbing inasmuch as the adjustment-neutral position 51 lies in the center of the stroke of the control sliders 71 and 81. For attaining a high position accuracy in this case, a second spring can be connected in parallel with the first spring 49 in the adjustment-neutral position 51. Thereby during the stroke of the control slider a force jump can be generated against which the neutral position can be reliably attained with the aid of the proportional magnet in force equilibrium. Further, it is possible to use also throttling locations, instead of the pressure valve 35 and pressurizing valve 48.

It will be understood that each of the elements described above, or two or more together, may also find a useful application in other types of constructions differing from the types described above.

While the invention has been illustrated and described as embodied in a control arrangement for a hydraulic motor, it is not intended to be limited to the details shown, since various modifications and structural changes may be made without departing in any way from the spirit of the present invention.

Without further analysis, the foregoing will so fully reveal the gist of the present invention that others, can by applying current knowledge, readily adapt it for various applications without omitting features that, from the standpoint of prior art, fairly constitute essential characteristics of the generic or specific aspects of the present invention.

What is claimed as new and desired to be protected by Letters Patent is set forth in the appended claims:

1. A control arrangement, comprising a hydraulic motor;

adjustable pressure medium supply means including a container and having an outlet;

an unblockable check valve having a control connection;

means forming a plurality of chambers including a supply chamber connected with said outlet of said supply means, a motor chamber arranged adjacent to said supply chamber and connected with said check valve, a first return chamber releasable in said container, a control chamber for connection with said control connection of said check valve, and a second return chamber located adjacent to said control chamber and connected therewith, said first return chamber being arranged so that the pressure medium flows back from the motor to said container, said second return chamber being associated only with a control flow of said check valve and said supply means;

means for connecting said control chamber with said control connection of said check valve, means for connecting said second return chamber with said control chamber;

a control conduit extending from said supply means and leading to said control chamber;

a control slider displaceable relative to said chambers so that during raising of said control slider it controls the pressure medium from said supply means via said check valve to the motor and during lowering of said control slider it releases the same to said container, said control slider controlling the connection between said control chamber and said second return chamber;

a first pressure controlling member arranged on said control slider in the region of said control chamber and said second return chamber so that in a lowered position of said control slider said first pressure controlling member is located between said control chamber and said second return chamber and blocks communication between said control chamber and said second return chamber around said control slider so that the pressure medium flows through said first pressure controlling member and produces a sufficiently high unblocking pressure for said check valve, said control slider in its raised position includes means blocking the communication between said control chamber and said second return chamber both around said control slider and through said first pressure controlling member, and said control slider in a neutral position includes means allowing direct communication between said control chamber and said second return chamber; and a second pressure controlling member communicating said control chamber and said motor chamber and opening to the latter.

2. A control arrangement as defined in claim 1, wherein said first pressure controlling member is formed as a pressure-dependent valve.

3. A control arrangement as defined in claim 1, wherein said second pressure controlling member is formed as a pressure responsive valve.

4. A control arrangement as defined in claim 1; and further comprising a spring and a proportional magnet actuating said slider against a force of said spring, and an electrical position-regulating circuit in which said control slider lies.

5. A control arrangement as defined in claim 4, wherein said proportional magnet is formed as a single-stroke magnet, said control slider having, in addition to its lowered and raised positions, an intermediate position between said lowered and raised positions, and a further position in which said control chamber is released to said second return chamber.

6. A control arrangement as defined in claim 1, wherein said adjustable pressure medium supply means includes a constant pump and a reverse valve arranged parallel to said supply chamber, said control conduit extending from said reverse valve.

7. A control arrangement as defined in claim 1, wherein said control slider has, in addition to its lowered and raised position, an inoperative neutral position in which said supply chamber is blocked from the other chambers and said control chamber is released to said second return chamber, said inoperative neutral position being located outside of said lowered and raised positions of said control slider.

8. A control arrangement as defined in claim 1, wherein said control slider has, in addition to its lowered and raised positions, an inoperative neutral position, said neutral position being located between said lowered and raised positions.

9. A control arrangement, comprising a hydraulic motor;

adjustable pressure medium supply means including a pump, a reverse valve, a container and having an outlet;

an unblockable check valve having a control connection;

means forming a plurality of chambers including a supply chamber connected with said outlet of said supply means, a motor chamber arranged adjacent to said supply chamber and connected with said check valve, a first return chamber releasable in said container, a control chamber for connection with said control connection of said check valve, and a second return chamber located adjacent to said control chamber and connected therewith, said first return chamber being arranged so that the pressure medium flows back from the motor to said container, said second return chamber being associated only with a control flow of said check valve and said supply means;

means for connecting said control chamber with said control connection of said check valve, means for connecting said second return chamber with said control chamber;

a control conduit extending from said reverse valve of said supply means and leading to said control chamber;

a control slider displaceable relative to said chambers so that during raising of said control slider it controls the pressure medium from said supply means via said check valve to the motor and during lowering of said control slider it releases the same to said container, said control slider controlling the connection between said control chamber and said second return chamber;

a first pressure controlling member arranged on said control slider in the region of said control chamber and said second return chamber so that in a lowered position of said control slider said first pressure controlling member is located between said control chamber and said second return chamber and blocks communication between said control chamber and said second return chamber around said control slider so that the pressure medium flows through said first pressure controlling member and produces a sufficiently high unblocking pressure for said check valve, said control slider in its raised position includes means the communication between said control chamber and said second return chamber both around said control slider and through said first pressure controlling member, and said control slider in a neutral position includes means allowing direct communication between said control chamber and said second return chamber; and a second pressure controlling member communicating said control chamber and said motor chamber and opening to the latter.

* * * * *